US006408764B1

(12) United States Patent
Heitmann et al.

(10) Patent No.: US 6,408,764 B1
(45) Date of Patent: Jun. 25, 2002

(54) CASE BASE FOR LARGE-CALIBER AMMUNITION

(75) Inventors: Thomas Heitmann, Unterlüss; Torsten Niemeyer, Celle, both of (DE)

(73) Assignee: Rheinmetall W & M GmbH, Unterluess (DE)

( * ) Notice: Subject to any disclaimer, the term of this patent is extended or adjusted under 35 U.S.C. 154(b) by 0 days.

(21) Appl. No.: 09/664,069

(22) Filed: Sep. 18, 2000

(30) Foreign Application Priority Data

Sep. 16, 1999 (DE) ..... 199 44 375

(51) Int. Cl.[7] ..... F42B 5/18; F42B 5/26
(52) U.S. Cl. ..... 102/469; 102/431; 102/467
(58) Field of Search ..... 102/430–433, 102/464, 466, 467, 469, 470, 700

(56) References Cited

U.S. PATENT DOCUMENTS 3,955,506 A * 5/1976 Luther et al. ..... 102/467
4,159,678 A * 7/1979 Luther et al. ..... 102/431
5,046,428 A * 9/1991 Jungblut et al. ..... 102/469
5,048,421 A * 9/1991 Swartout ..... 102/469
5,467,716 A * 11/1995 Boual ..... 102/430
5,563,365 A * 10/1996 Dineen et al. ..... 102/431
6,131,519 A * 10/2000 Thresen et al. ..... 102/469

FOREIGN PATENT DOCUMENTS

DE 81680 C 5/1894
DE 4229559 A 3/1994
DE 19729291 A 1/1999
FR 1113479 A 12/1955

* cited by examiner

*Primary Examiner*—Harold J. Tudor
(74) *Attorney, Agent, or Firm*—Venable; Norman N. Kunitz

(57) ABSTRACT

A case base (1; 1') for large-caliber ammunition, in which the case jacket (2) comprises a combustible material, with the case base (1; 1') comprising a metallic base plate (3) and a support ring (4; 4') that projects axially beyond the surface of the base plate (3) at its edge, and an elastomer or thermoplastic obturation ring (5; 5') that is disposed on the projectile side of the support ring (4; 4'). In order for the obturation ring (5; 5') to be secured simply to the support ring (4; 4') and removed again after the ammunition has been fired, the support ring (4; 4') has, on its inner surface (6) facing the obturation ring (5; 5'), a groove-shaped undercut (7), into which the end (8) of the obturation ring (5; 5') that faces the support ring (4; 4') extends with a form-fit and/or positive lockup.

6 Claims, 1 Drawing Sheet

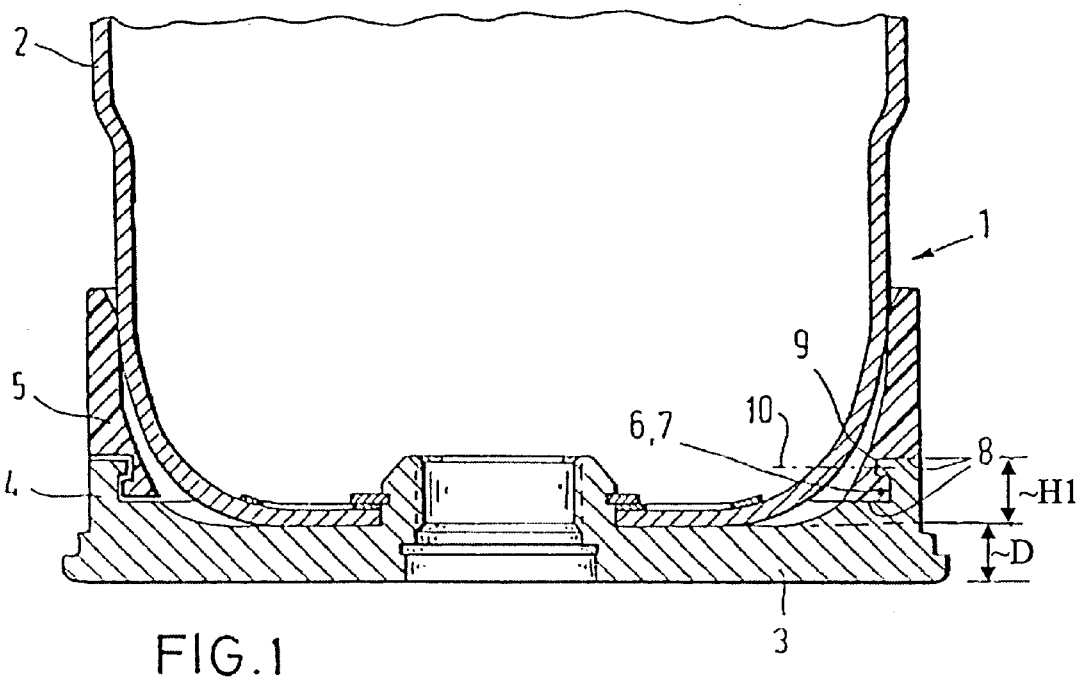
FIG.1
FIG.2
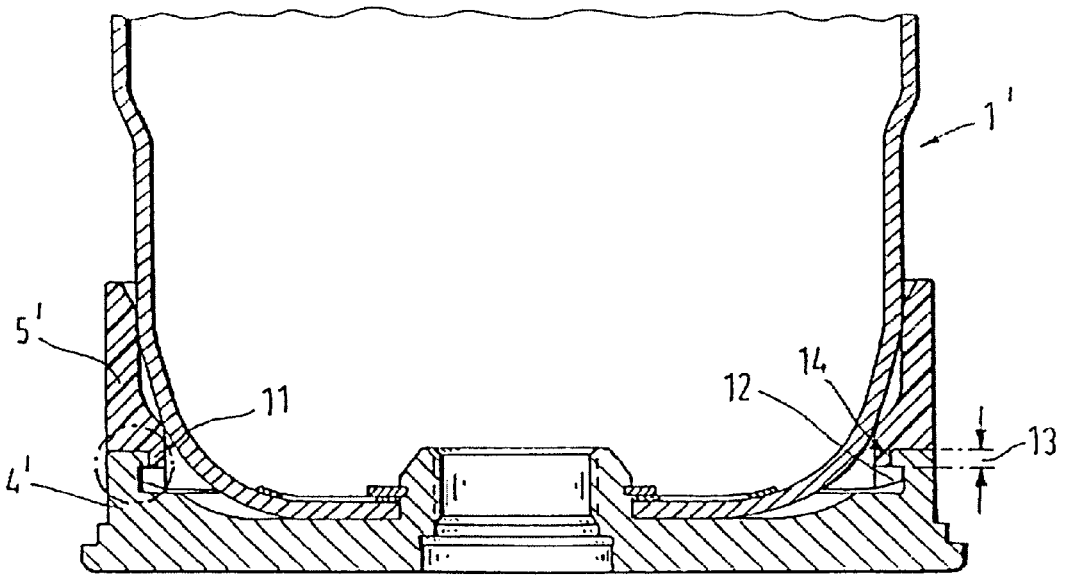

CASE BASE FOR LARGE-CALIBER AMMUNITION

BACKGROUND OF THE INVENTION

The invention relates to a case base for large-caliber ammunition, in which the case jacket comprises a combustible material.

A case base of this type is known from, for example, DE 23 03 790 C3. It comprises a metallic base plate and a support ring (case stub) that projects axially beyond the base plate at its edge and is provided with a pullout edge. The support ring serves to support the base side of the case jacket, and assures a gas-tight seal when a shot is fired (case obturation), because it expands in the barrel due to the fairly high gas pressures, and rests radially against the weapon barrel. The known case base further includes a rubber obturation ring that is disposed on the projectile side of the support ring One of the disadvantages of the known case base is that it is relatively costly to produce, because the high stresses during firing require the use of a forged steel blank, which must then be quenched and drawn in a special heat treatment, and then finished by machining. The known case base is only reusable once, because it must be machined for reuse, and the support and sealing ring could not assure the obturation in repeated use.

It is known from DE 42 29 559 A1 to construct the case base of large-caliber ammunition in two parts, namely a metallic base plate and a separate, metallic support and sealing ring. The base plate and the support and sealing ring are connected with a form fit that allows a radial decoupling of the two parts, that is, when the support and sealing ring expands radially, the sealing ring exerts no significant tensile forces on the base plate. Consequently, the base plate can be produced from a less solid material than the support and sealing ring. The initial obturation is, again, effected by means of an additional, relatively narrow elastomer ring.

One drawback of this case base is that it is likewise relatively costly to produce because of the multiple parts of base plate and case stub, and the necessity of connecting these parts to one another.

Finally, German Patent No. DE 197 29 291.7 discloses a case base in which there is no case obturation. Instead, this function is assumed by an elastomer ring that is correspondingly wide and is inexpensive to produce, the ring being exchanged from shot to shot and simultaneously performing the initial obturation.

As in the cited document DE 23 03 790 C3, in this case base, the base plate and the support ring are embodied in one piece, but the height of the support ring projecting beyond the base plate in DE 197 29 291.7 is so low that the case jacket is only guided and supported to a certain degree in the base-side region, but the base plate no longer expands notably. For this reason, it is no longer necessary to use a forged material for the base plate.

In the above-described case base, the elastomer ring is vulcanized or glued onto the base plate over a wide surface in order to transmit the necessary axial forces for removing the case base from the weapon barrel. It is fairly time-consuming to produce the connection between the base plate or support ring and the obturation ring. Moreover, the elastomer ring must be mechanically removed for the reuse of the base plate, which is an involved process.

In view of DE 197 29 291.7, it is the object of the invention to provide a case base in which the obturation ring is secured to the support ring in a simple manner, and can be removed again after the ammunition has been fired.

SUMMARY OF THE INVENTION

The above object generally is achieved according to the present invention by a case base for large-caliber ammunition having a case jacket comprising a combustible material, wherein: the case base comprises a metallic base plate and a support ring that projects axially beyond the base plate at an edge of the base plate and an obturation ring that is disposed on the projectile side of the support ring and is formed of an elastomer or thermoplastic; the base plate and the support ring are embodied in one piece; the height H1 of the support ring projecting beyond the base plate has the following relationship: $0<H1<2D$, where D represents the wall thickness of the base plate; and, on its inner surface facing the obturation ring , the support ring has a groove-shaped undercut, into which the end or the obturation ring facing the support ring extends, with at least one of a form-fit and a positive lockup. Further advantageous embodiments of the invention are disclosed.

The basic concept of the invention is that, on its inside facing the obturation ring, the support ring has a groove-shaped undercut, into which the end of the obturation ring facing the support ring extends, with a form-fit and/or positive lockup.

In the simplest case, the support ring and obturation ring can be connected to one another by a snap connection. The obturation ring, which comprises an elastomer or thermoplastic, can be produced externally and then pressed onto the support ring. To simplify this joining process, slots can be provided on the obturation ring in the snap region.

In a further embodiment of the invention, it has proven advantageous to vulcanize or inject the end of the obturation ring facing the support ring onto the support ring.

Further details and advantages of the invention ensue from the following embodiments explained in conjunction with the figures.

BRIEF DESCRIPTION OF THE DRAWINGS

FIGS. 1 and 2 are longitudinal sections of two embodiments of case bases according to the invention.

DETAILED DESCRIPTION OF THE PREFERRED EMBODIMENTS

In FIG. 1, a case base for a large-caliber cartridge is indicated by 1, and 2 represents a case jacket comprising or formed of a combustible material. The case base 1 comprises a unitary or one piece structure including a steel base plate 3 having a wall thickness D, and a support ring 4 that projects slightly beyond the base plate in the axial direction at the edge of the base plate. The corresponding height of the support ring 4, relative to the inner surface of the base plate 3, is represented by H1, and the following relationship applies for H1: $0<H1<2D$.

On the projectile side, an obturation ring 5 comprised of an elastomer, e.g., rubber, or a thermoplastic adjoins and is supported on the support ring 4. On its inner surface 6 facing the obturation ring 5, the support ring 4 has a groove-shaped undercut 7, into which the lower end 8 of the obturation ring 5, which lower end extends into the support ring 4 and faces the inner surface 6, extends with a form-fit and/or positive lockup. For this purpose, according to one embodiment of the invention, the end of the obturation ring 5 that faces the support ring 4 is vulcanized or injected onto the support ring.

Should the obturation ring 5 not release easily from the support ring 4 after firing, the obturation ring 5 can be separated by a simple knife cut, e.g. in the region of the undercut 9 formed in the obturation ring 5, and the ensuing two individual pieces are then removed from the support ring 4. The corresponding separation line is shown as a dashed line in FIG. 1 and provided with the reference numeral 10.

In FIG. 2, a case base that essentially corresponds to that of FIG. 1 is represented by 1'. In this base, however, the obturation ring 5' is not vulcanized or injected onto the support ring 4', but produced as a separate part, then connected to the support ring 4' by a snap connection 11. To simplify the joining, the obturation ring 5' is provided with slots 12 in the snap region. For a good initial obturation, the manufacturing tolerances for the support ring 4' and the obturation ring 5' should preferably allow the formation of press fits at 13 and 14.

The invention now being fully described, it will be apparent to one of ordinary skill in the art that many changes and modifications can be made thereto without departing from the spirit or scope of the invention as set forth herein.

We claim:

1. A case base for large-caliber ammunition having a case jacket comprising a combustible material, wherein:

the case base comprises a metallic base plate and a support ring that projects axially beyond the base plate at an edge of the base plate, and an obturation ring that is disposed on a projectile side of the support ring, is formed of an elastomer or a thermoplastic, and has a lower end extending into and facing an inner surface of the support ring;

the base plate and the support ring are embodied as a unitary structure;

the height H1 of the support ring projecting beyond the base plate has the following relationship: $0<H1<2D$, where D represents the wall thickness of the base plate; and, on its inner surface facing the obturation ring, the support ring has a groove-shaped undercut into which the end of the obturation ring facing the support ring extends, with at least one of a form-fit and a positive lockup.

2. The case base according to claim 1, wherein the obturation ring is slotted at its end facing the support ring and engages in the grove-shaved undercut of the support ring in a snap fit.

3. The case base according to claim 1, wherein the end of the obturation ring that faces the support ring is vulcanized or injected onto the support ring.

4. A case base for large-caliber ammunition having a case jacket comprising a combustible material, wherein:

the case base comprises a metallic base plate and a support ring that projects axially beyond the base plate at an edge of the base plate, and an obturation ring that is disposed on a projectile side of the support ring, is formed of an elastomer or a thermoplastic, and has a lower end extending only into and facing an inner surface of the support ring;

the base plate and the support ring are embodied as a unitary structure;

the height H1 of the support ring projecting beyond the base plate has the following relationship: $0<H1<2D$, where D represents the wall thickness of the base plate;

the support ring has a groove-shaped undercut only on its inner surface facing the obturation ring; and the end of the obturation ring facing the inner surface of the support ring extends into the groove-shaped undercut with at least one of a form-fit and a positive lockup.

5. The case base according to claim 4, wherein the obturation ring is slotted at its end facing the support ring and engages in the groove-shave undercut of the support ring in a snap fit.

6. The case base according to claim 4, wherein the end of the obturation ring that faces the support ring is vulcanized or injected onto the support ring.

* * * * *